US009604465B2

(12) United States Patent
Suzuki et al.

(10) Patent No.: US 9,604,465 B2
(45) Date of Patent: Mar. 28, 2017

(54) INK-JET RECORDING APPARATUS

(71) Applicant: CANON KABUSHIKI KAISHA, Tokyo (JP)

(72) Inventors: Kazuo Suzuki, Yokohama (JP); Masaya Uetsuki, Yokohama (JP); Toshimitsu Danzuka, Tokyo (JP); Masataka Kato, Yokohama (JP); Tsuyoshi Ibe, Yokohama (JP); Asako Tomida, Kawasaki (JP); Shin Genta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/158,463

(22) Filed: May 18, 2016

(65) Prior Publication Data

US 2016/0347079 A1 Dec. 1, 2016

(30) Foreign Application Priority Data

May 27, 2015 (JP) ..... 2015-107874

(51) Int. Cl.
*B41J 2/195* (2006.01)
*B41J 2/175* (2006.01)

(52) U.S. Cl.
CPC ..... *B41J 2/17566* (2013.01)

(58) Field of Classification Search
CPC ..... B41J 2/17566; B41J 2/17596
See application file for complete search history.

(56) References Cited

U.S. PATENT DOCUMENTS 8,336,999 B2 * 12/2012 Matsumoto ..... B41J 2/17509 347/85
8,454,136 B2 * 6/2013 Katoh ..... B41J 2/17509 347/85

FOREIGN PATENT DOCUMENTS

JP 2010-208151 A 9/2010

* cited by examiner

*Primary Examiner* — Juanita D Jackson
(74) *Attorney, Agent, or Firm* — Canon USA, Inc., IP Division

(57) ABSTRACT

A recording apparatus includes a recording head, a sub tank, an ink tank containing ink supplied to the sub tank, a detector that detects an amount of ink contained in the sub tank, a variable volume member provided between the recording head and the sub tank and having variable inner volume, and a controller that repeatedly performs first and second operations, thereby supplying ink from the ink tank to the sub tank. In the first operation, the member is caused to switch from a first state to a second state, while in the second operation, the member is caused to switch from the second state to the first state.

9 Claims, 15 Drawing Sheets

INK-JET RECORDING APPARATUS

BACKGROUND

Field

Aspects of the present invention generally relate to a recording apparatus using an ink-jet method.

Description of the Related Art

A recording apparatus disclosed in Japanese Patent Laid-Open No. 2010-208151 performs recording operation by supplying ink from an ink tank to a recording head via a sub tank. The recording apparatus has a variable volume member (diaphragm valve) between the sub tank and the recording head. The variable volume member has an on-off valve function of opening and closing an ink flow passage. Sub-tank filling operation is performed by increasing and decreasing the volume of the variable volume member to supply ink from the ink tank to the sub tank, thereby filling the sub tank with the ink. When the sub-tank filling operation is performed, the amount of ink contained in the sub tank is detected by means of a detection sensor provided inside the sub tank.

However, the inventors found that, if the structure disclosed in Japanese Patent Laid-Open No. 2010-208151 is used, in some cases, it is impossible to detect the amount of ink contained in the sub tank accurately when the sub-tank filling operation is performed. More specifically, the inventors found that it is sometimes detected erroneously that the sub tank is filled with ink despite the fact that there is an empty space inside the sub tank.

SUMMARY

Aspects of the present invention provide an ink-jet recording apparatus that enable detecting the amount of ink contained in a sub tank accurately.

According to an aspect of the present invention, an ink-jet recording apparatus includes a recording head configured to eject ink, a sub tank containing ink to be supplied to the recording head, an ink tank containing ink to be supplied to the sub tank, a detector configured to detect an amount of ink contained in the sub tank, a variable volume member provided between the recording head and the sub tank and configured to change inner volume, and a controller configured to repeatedly perform first operation and second operation, thereby supplying the ink from the ink tank to the sub tank, the first operation causing the variable volume member to switch from a first state to a second state, the second operation causing the variable volume member to switch from the second state to the first state, wherein volume of the variable volume member in the second state is larger than the volume in the first state, wherein the controller prohibits the detector from detecting the amount of the ink during a period of time in which the first operation is performed.

Further features of aspects of the present invention will become apparent from the following description of exemplary embodiments with reference to the attached drawings.

DESCRIPTION OF THE EMBODIMENTS

First Embodiment

With reference to the attached drawings, exemplary embodiments of the present invention will now be explained in detail.

1 Structure of Ink-Jet Recording Apparatus 1-1 Overview

Figure 1:
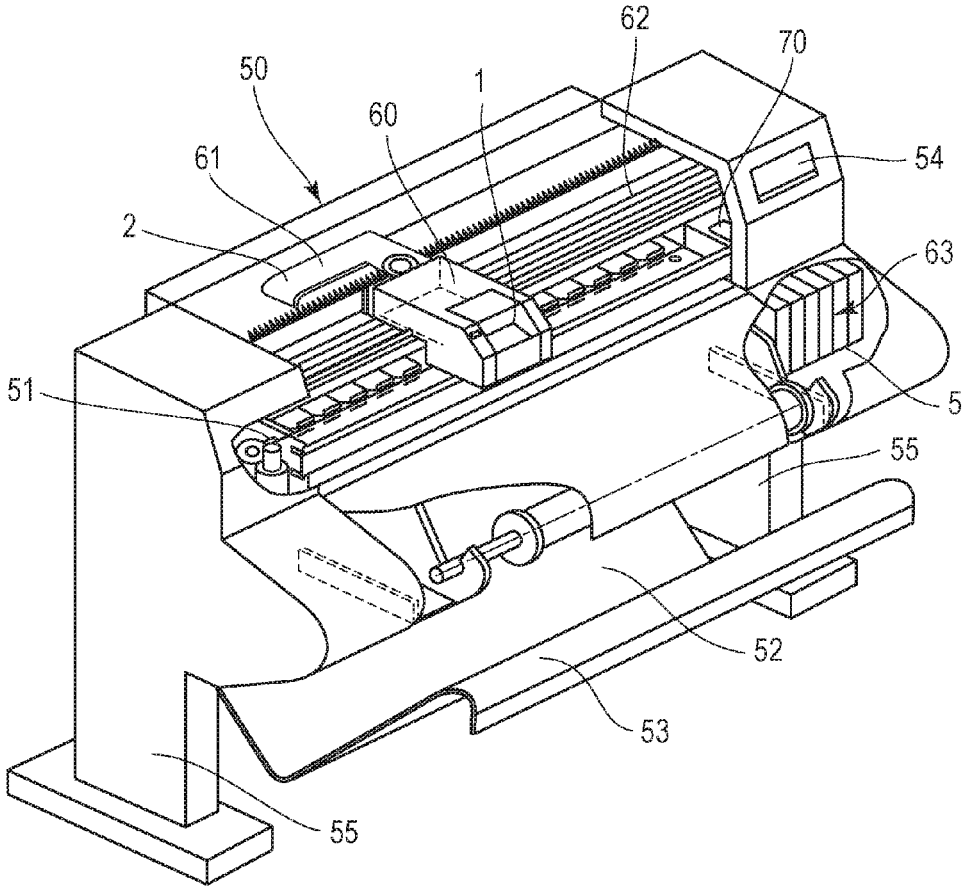
FIG. 1 is a perspective view of an ink-jet recording apparatus according to an exemplary embodiment of the present invention.

FIG. 1 is a perspective view of an ink-jet recording apparatus according to an exemplary embodiment of the present invention. The body of a recording apparatus 50 is supported horizontally on the top portion of two legs 55, which faces each other, over a space between these two legs. A recording head 1 is mounted on a carriage 60. The recording head 1 has an ejection surface (nozzle surface). Plural ejection orifices (nozzles), through which ink droplets are ejected, are arranged in rows (nozzle rows) in a first direction in the ejection surface.

A recording target medium (sheets) is set on a conveyance roll holder unit 52. The recording sheet is conveyed in a first direction to a position where it faces the recording head 1 at the time of recording. Driven by a carriage motor (not illustrated) via a belt transmission member 62, the carriage 60 reciprocates in a second direction, which is orthogonal to the first direction. During the reciprocation of the carriage 60, recording operation for printing one band of an image is performed by ejecting an ink droplet onto the surface of the recording sheet from each ink nozzle formed in the recording head 1.

Upon the arrival of the carriage 60 at one side of the recording sheet, sheet conveyance operation is performed. Specifically, the recording sheet is conveyed by a conveyance roller 51 by a predetermined amount in the first direction. The recording operation and the conveyance operation described above are repeated alternately. As a result, an image is recorded on the entire recording target area of the sheet. After the completion of image recording on the entire recording target area of the sheet, the sheet is cut by a cutter that is not illustrated. The sheet(s) after the cutting process is stacked on a stacker 53.

An ink supply device 63 has detachable ink tanks 5. Ink is contained in the ink tanks 5. Each of the ink tanks 5 is provided separately for the corresponding one of ink colors, for example, black, cyan, magenta, and yellow. The ink tank 5 is connected to a sub tank 4. Supply tubes 2 are connected to the sub tank 4. The supply tubes 2 are bundled together and fixed to a tube guide 61 so as to prevent non-bundled violent movement from occurring due to the reciprocation of the carriage 60. The supply tubes 2 are connected to the respective nozzle rows of the recording head 1. The structure of the ink supply device will be described in detail later.

A recovery unit 70 is provided outside a recording sheet area in the second direction at a position where it can be capped on the nozzle surface of the recording head 1. The recovery unit 70 sucks ink or air out of the nozzle surface of the recording head 1 when necessary.

A variable volume member 3, which can change its inner volume, is provided between the recording head and the sub tank. The variable volume member 3 has an on-off valve function of switching the state of an ink flow passage between the recording head and the sub tank by increasing/decreasing its inner volume, specifically, switching between a state in which the ink flow passage is closed (closed state) and a state in which the ink flow passage is open (open state).

The recovery unit 70 can increase negative pressure inside the recording head 1 and perform suction operation (valve-closed suction) by applying a suction force thereto in a state in which the ink flow passage between the recording head and the sub tank is closed by the variable volume member 3 (closed state).

In a front view, an operation panel 54 is provided on the right portion of the recording apparatus 50. The operation panel 54 displays a ("warning") message that lets the user know empty tank status when no ink is left in the ink tank 5 so as to prompt the user to replace the empty tank 5 with new one.

1-2 Structure of Ink Supply Device

Figure 2:
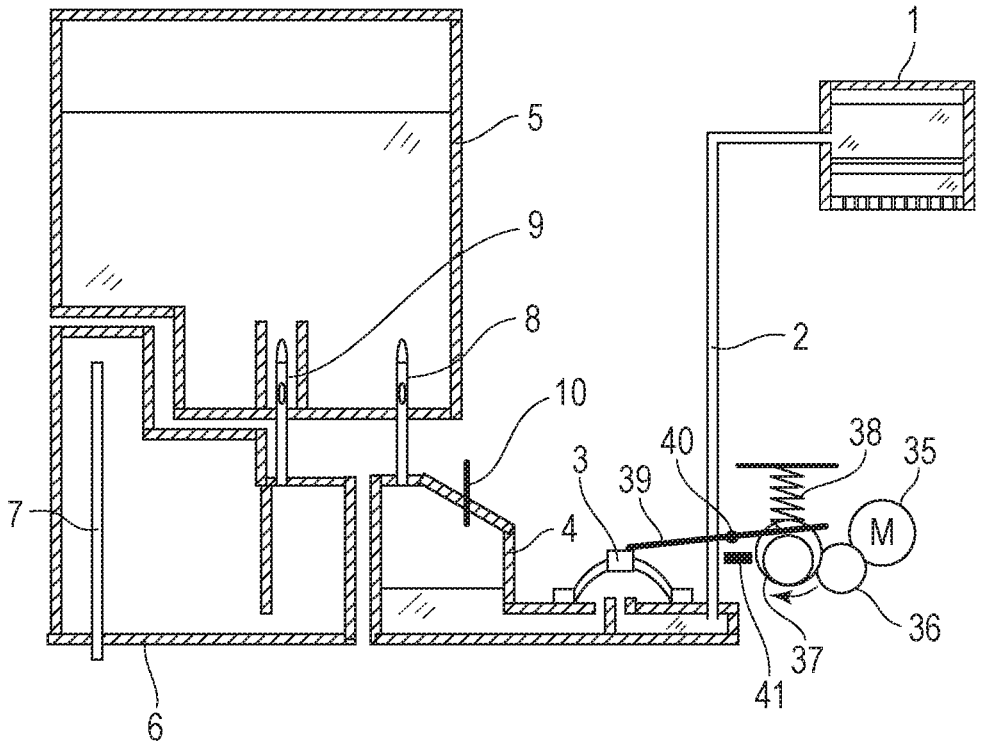
FIG. 2 is a schematic view of an ink supply device according to an exemplary embodiment of the present invention.

FIG. 2 is a schematic view of an ink supply device according to an exemplary embodiment of the present invention. The ink tank 5 has two joint portions on its bottom. The joint portions are connected respectively to a first hollow pipe 8 and a second hollow pipe 9 of the device. Each of the first hollow pipe 8 and the second hollow pipe 9 is a metal needle. A wall rising from the tank bottom surface is formed inside the ink tank 5 around the second hollow pipe 9. When an electric current that is very week is applied between the first hollow pipe 8 and the second hollow pipe 9, a voltage value is large if the surface level of liquid ink is lower than the height of the rising wall. Therefore, it is possible to detect that the amount of ink left in the ink tank 5 is small ("near end") by detecting the value of the voltage, or the value of the current.

The second hollow pipe 9 is connected to an air communication chamber 6 (buffer tank). The ink tank 5 is in communication with the outside air through the second hollow pipe 9 and an air communication passage 7. The air communication passage 7 is provided substantially inside the air communication chamber 6. The first hollow pipe 8 is connected to the top surface of the sub tank 4, which has invariable volume. The ink tank 5 is in communication with the sub tank 4 through the first hollow pipe 8, which is inserted through the tank bottom.

The sub tank 4 has a slope that increases cross-section size as viewed from the top perpendicularly downward. At the highest position of the sub tank 4, the sub tank 4 is connected to the first hollow pipe 8.

A solid pipe 10, which is made of metal, is provided partially inside the sub tank 4. The first hollow pipe 8 and the solid pipe 10 make up a pair of electrodes. It is possible to detect whether the sub tank is filled with ink (full tank) or not by measuring a voltage value or a current value that is obtained when an electric current that is very week is applied between the first hollow pipe 8 and the solid pipe 10 (between the electrodes). If the sub tank is filled with ink, the voltage value is small because the current flows via the ink. If the sub tank is not filled with ink, the voltage value is large because this makes it harder for the current to flow. It is possible to detect the amount of ink contained in the sub tank by utilizing this difference.

The sub tank 4 is in communication with the recording head 1 through the supply tubes 2. The sub tank 4 has an ink outlet from which ink flows out toward the recording head 1. The ink outlet is located at the lowest position of a side of the sub tank 4.

The variable volume member 3 is provided on an ink flow passage between the ink outlet of the sub tank 4 and the recording head 1. The variable volume member 3 is urged in a push-up direction by a compression spring 38. In a state in which the variable volume member 3 is pushed up, the ink flow passage is open (open state). A lever 39 turns on the center axis 40 when a cam 37 rotates in the direction of an arrow. The turning of the lever 39 decreases the volume of the variable volume member 3, thereby closing the ink flow passage (closed state). The rotary position of the cam 37 can be detected by means of a photo sensor 41. The rotation of the cam 37 is controlled via a gear 36 by a DC motor 35, which is a cam driver. In the ink supply device, the levers 39 corresponding respectively to all of the ink colors are interconnected. The opening and closing of the variable volume members 3 corresponding respectively to all of the ink colors are controlled at the same time by a single DC motor 35.

2 Architecture of Control System

Figure 3:
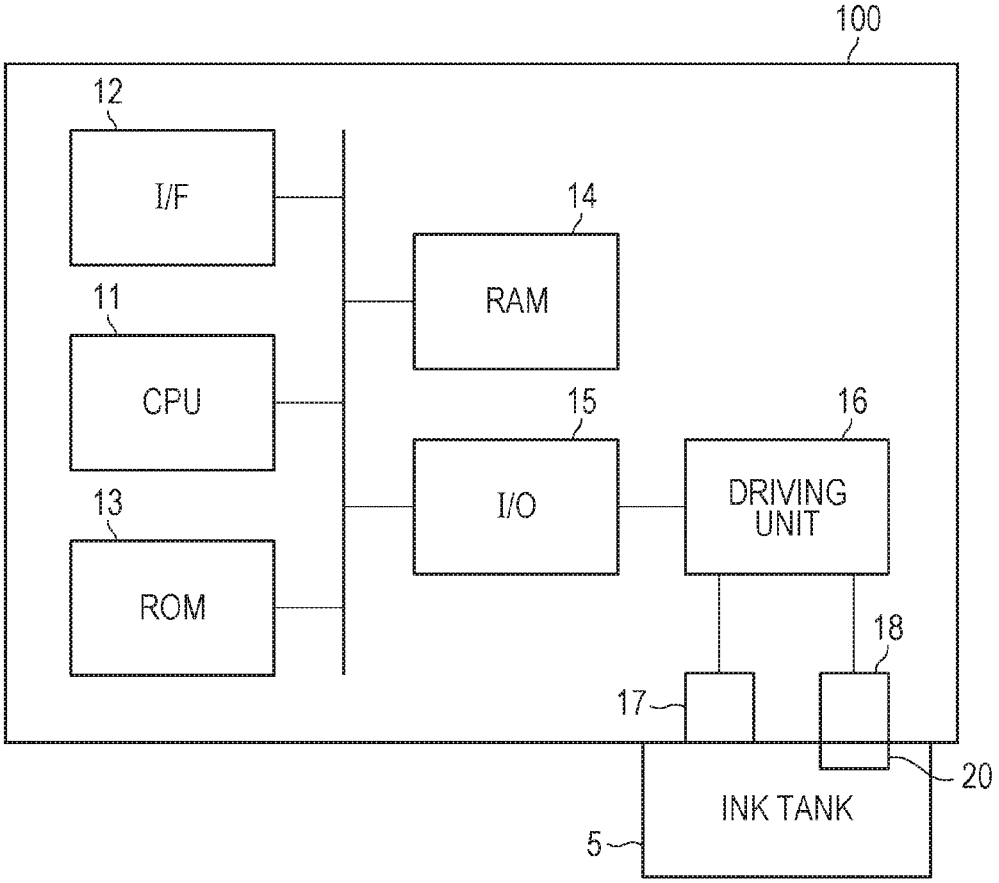
FIG. 3 is a block diagram that illustrates the architecture of a control system according to an exemplary embodiment of the present invention.

FIG. 3 is a block diagram that illustrates the architecture of a control system in an ink-jet recording apparatus according to an exemplary embodiment of the present invention. The ink-jet recording apparatus includes a CPU 11, which controls processing in the apparatus, and a user interface 12, which includes user operation keys and an operation panel for information display. In addition, the ink-jet recording apparatus includes a ROM 13, in which control software is stored, a RAM 14, which temporarily stores data for operating the control software, and an I/O 15 to a driving unit 16. The ink-jet recording apparatus further includes an ink remaining amount sensor 17, which is capable of detecting the amount of ink left in the ink tank, and an ink tank attachment sensor 18, which is capable of detecting the attachment/detachment of the ink tank. As described earlier, the ink remaining amount sensor 17 is capable of detecting whether the amount of ink left in the ink tank is small ("near end") or not by detecting the value of a voltage, or the value of a current, between the two metal needles (between the electrodes). The ink tank attachment sensor 18 is capable of detecting the attachment/detachment of the ink tank by reading the content of an EEPROM 20 provided on the ink tank.

3 Control Procedure 3-1 Nonstop Recording Control

FIG. 4 is flowchart that shows the procedure of nonstop recording control according to an exemplary embodiment of the present invention. Since the ink-jet recording apparatus is equipped with the sub tank in addition to the ink tank, even when no ink is left in the ink tank, it is possible to continue recording operation by consuming ink contained in the sub tank during a period before the replacement of the empty ink tank with new one (nonstop recording).

Figure 4B:
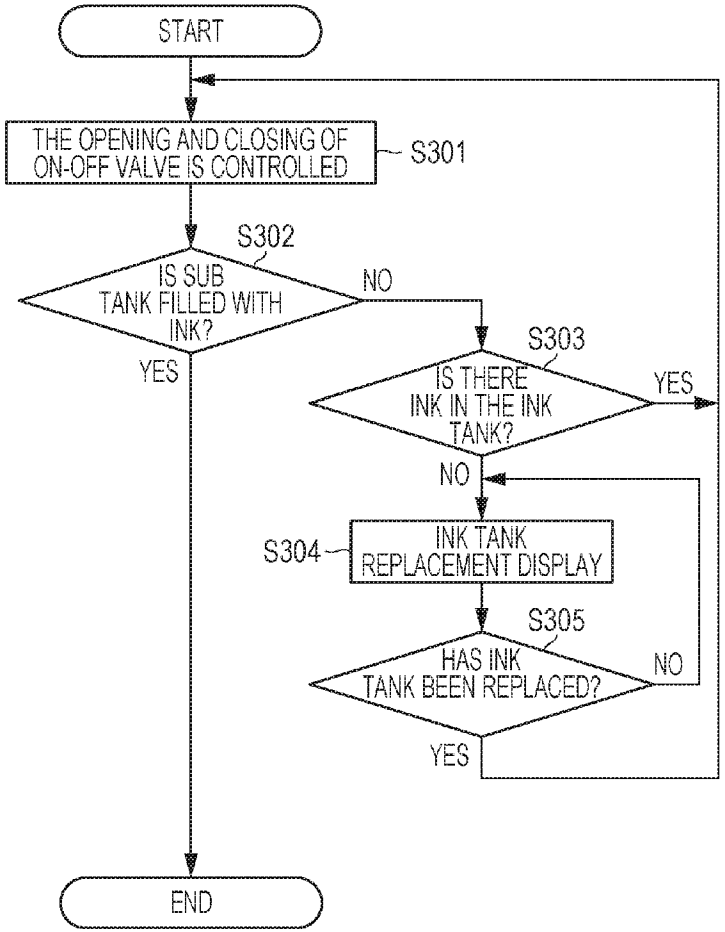
FIG. 4B is flowchart that shows the procedure of sub-tank filling control according to an exemplary embodiment of the present invention.
Figure 4A:
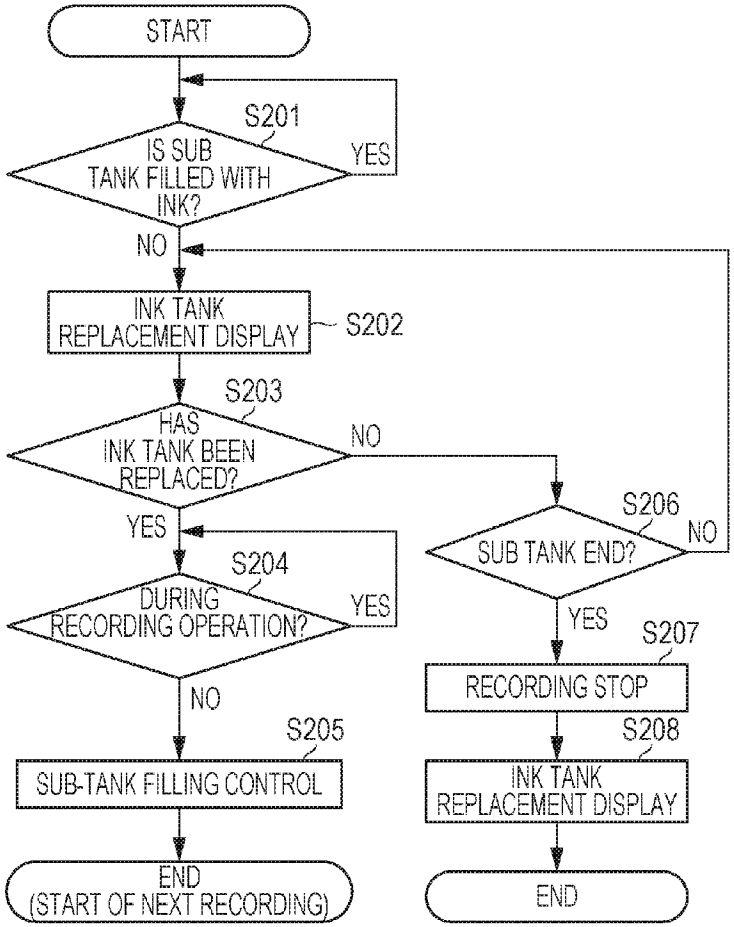
FIG. 4A is flowchart that shows the procedure of nonstop recording control according to an exemplary embodiment of the present invention.
Figure 5:
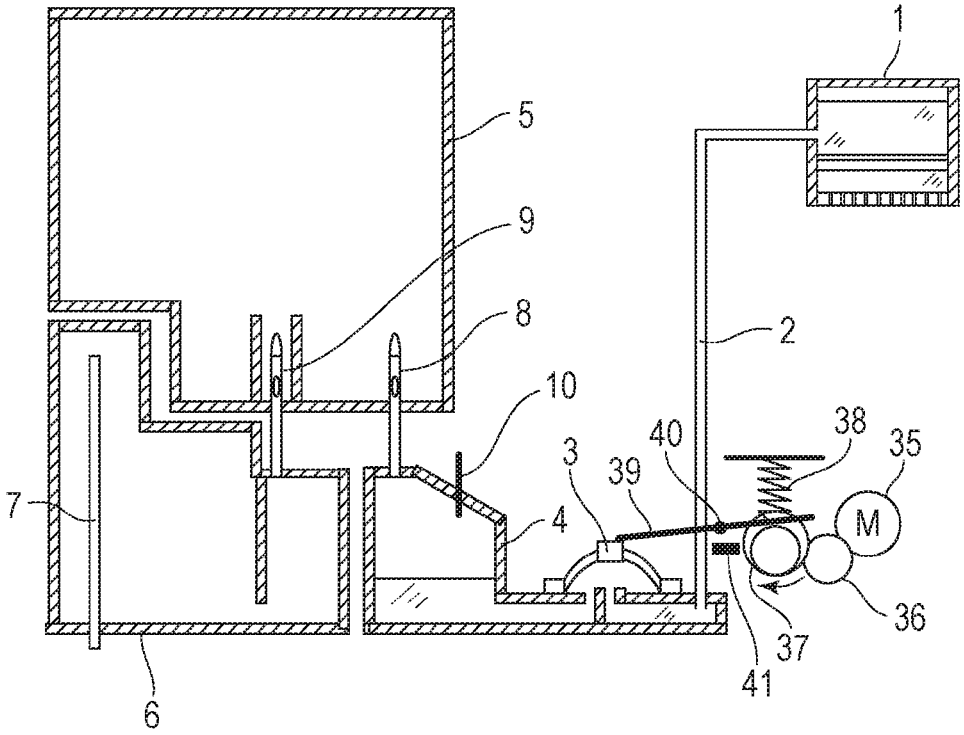
FIG. 5 is a schematic view of an ink supply device during nonstop recording operation according to an exemplary embodiment of the present invention.

FIG. 4A is a flowchart that shows a series of processes for performing recording operation by consuming ink contained in the sub tank 4. FIG. 5 is a schematic view of an ink supply device during nonstop recording operation.

In FIG. 4A, first, in S201, it is judged whether the sub tank 4 is filled with ink (full tank) or not. If ink contained in the sub tank 4 is consumed after the ink tank 5 has run out of ink (when no ink is left in the ink tank 5), air enters the sub tank 4 via the ink tank 5 through the air communication passage 7. The air having gone into the sub tank 4 stays and accumulates at the top space inside the sub tank 4. Because of the presence of the air, the first hollow pipe 8 and the solid pipe 10 are not "connected" to each other via ink. Since this makes it harder for an electric current to flow between the first hollow pipe 8 and the solid pipe 10, the voltage value increases. Therefore, the consumption of ink contained in the sub tank 4 (not filled with ink) is detected. If the consumption of ink contained in the sub tank 4 is detected in S201, it is evident that no ink is left in the ink tank 5. Therefore, in this case, a message saying that ink tank replacement is necessary is displayed on the operation panel in S202.

During a period before the replacement of the empty ink tank 5 with new one, recording operation can be continued until the consumable amount of ink contained in the sub tank 4 will have been used up. In the present embodiment, the consumable amount, that is, the acceptable amount of use, is approximately 11 ml. This acceptable amount of use is determined on the basis of the amount of ink that is necessary when the recording apparatus performs recording on one sheet of maximum-sized recording target medium (paper) at 100% density.

To judge whether the consumable amount (acceptable amount of use) of ink contained in the sub tank 4 has been used up or not, the following method is used. First, the acceptable amount of use is stored into the memory of the recording apparatus in advance. Next, the amount of ink consumed is calculated by counting the number of ejections from the recording head. The amount of ink consumed is compared with the acceptable amount of use (consumable amount). By this means, it is possible to judge whether the consumable amount of ink contained in the sub tank 4 has been used up or not. The scope of the aspects of the present invention is not limited to the method described above. For example, a detection sensor that detects sub-tank ink empty status may be used for the above judgment.

If it is judged in S203 that the empty ink tank has been replaced with new one, sub-tank filling control is performed during a pause (after the completion of recording of one band, before the start of the next recording) in recording operation (S204-S205). The sub-tank filling control will be described in detail later. After the completion of the sub-tank filling control, the next recording operation is started.

If it is judged (S206) that the consumable amount of ink contained in the sub tank 4 has been used up before the replacement of the empty ink tank with new one, the recording operation is stopped (S207). Since the recording operation is stopped, it is possible to prevent a poor image due to, for example, ink non-ejection caused by air entering the recording head 1 through the ink flow passage via the sub tank 4. After that, a message saying that ink tank replacement is necessary is displayed, and the replacement of the ink tank 5 is waited for (S208).

3-2 Sub-Tank Filling Control

FIG. 4B is a detailed flowchart of the sub-tank filling control in S205 illustrated in FIG. 4A. In FIG. 4A, if the consumption of ink contained in the sub tank 4 is detected (S201), if the empty ink tank has been replaced with new one (S203), and further if the recording operation comes to a pause (S204), the sub-tank filling control illustrated in FIG. 4B is performed.

Figure 6A:
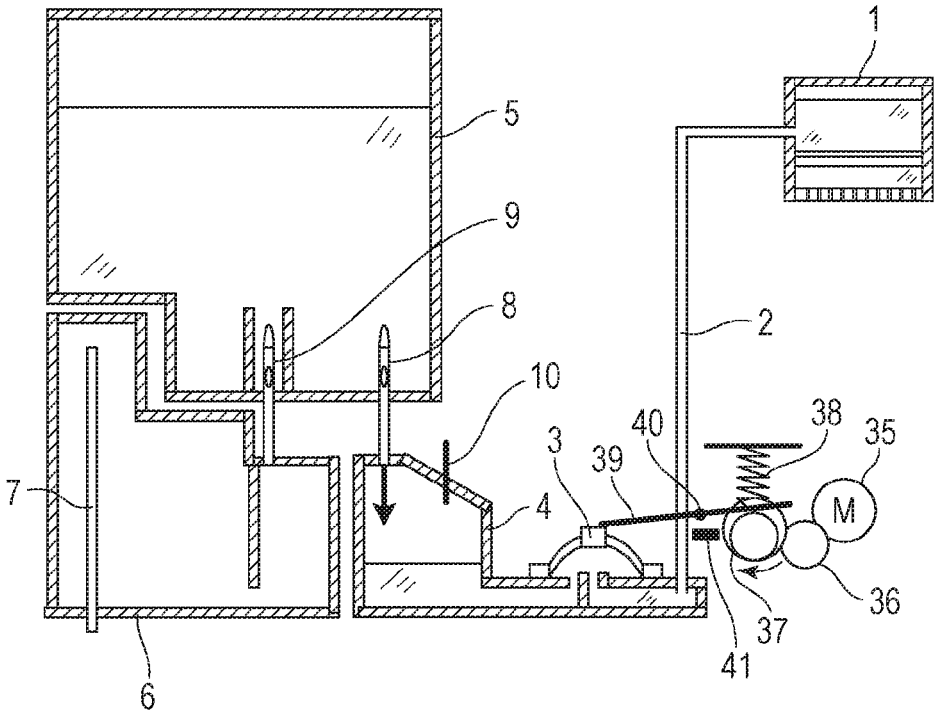
FIG. 6A is a schematic view for explaining the sub-tank filling operation according to an exemplary embodiment of the present invention.
Figure 6B:
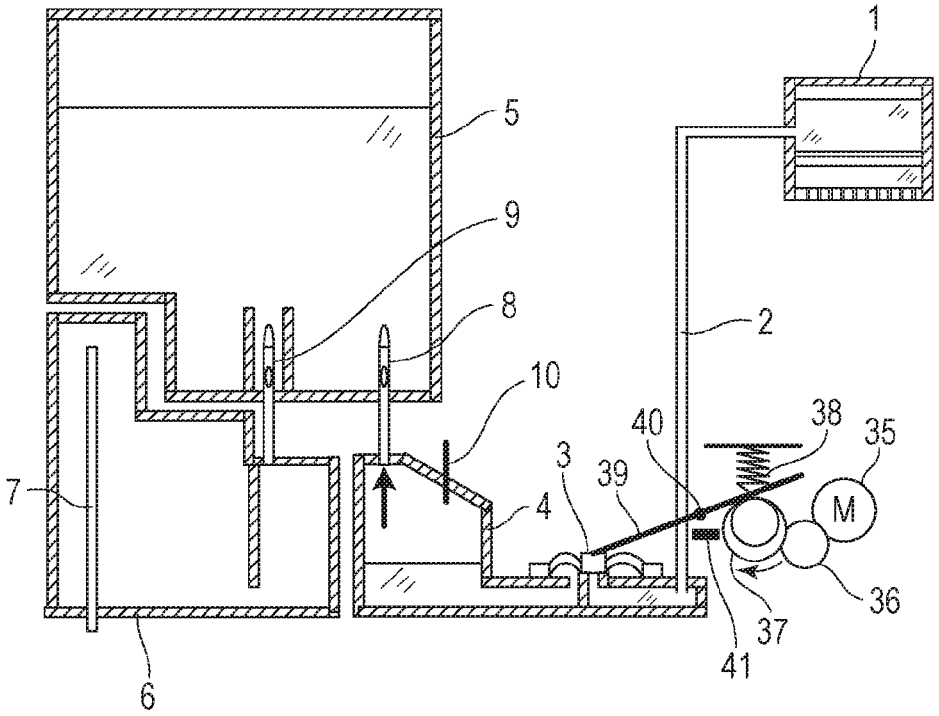
FIG. 6B is a schematic view for explaining the sub-tank filling operation according to an exemplary embodiment of the present invention.

FIG. 6 is a schematic view for explaining the sub-tank filling operation. FIG. 6A shows a state in which the variable volume member 3 is open. FIG. 6B shows a state in which the variable volume member 3 is closed. Let V1 be the volume of the variable volume member 3 (in the present embodiment, approx. 0.45 ml). Let V2 be the volume of the first hollow pipe 8 (in the present embodiment, approx. 0.09 ml). A relationship of V1>V2 holds true between the volume of the variable volume member 3 and the volume of the first hollow pipe 8.

When the variable volume member 3 switches from the closed state to the open state, ink, the volume of which is equal to the volume V1−V2 (approx. 0.36 ml), is supplied from the ink tank 5 to the sub tank 4. The volume of the ink supplied is defined as V3 (=V1−V2). When the ink is supplied, air that has a volume of V3 flows into the ink tank 5 via the air communication chamber 6. After that, the DC motor 35 drives the cam 37. As illustrated in FIG. 6B, the cam 37 rotates and causes the lever 39 to press the variable volume member 3 down. Since this puts the variable volume member 3 into the closed state from the open state, air that has a volume of V3 is forced into the ink tank 5 out of the sub tank 4. At the same time, ink that has a volume of V3 is forced into the air communication chamber 6 out of the ink tank 5. Pressure loss in the ink flow passage from the variable volume member 3 to the ejection orifices of the recording head 1 is far greater than pressure loss in the passage from the variable volume member 3 to the ink tank 5. For this reason, almost no ink flows toward the recording head 1. After that, as illustrated in FIG. 6A, the DC motor 35 causes the cam 37 to rotate in the direction indicated by the arrow. The cam rotation allows the lever 39, which is urged by the compression spring 38, to turn, thereby switching the variable volume member 3 from the closed state to the open state. In this process, ink that has a volume of V3 is sucked into the ink tank 5 from the air communication chamber 6 and, at the same time, ink that has a volume of V3 is sucked into the sub tank 4 from the ink tank 5. After that, the DC motor 35 rotates again for a switchover of the variable volume member 3 from the open state to the closed state.

In S301 of FIG. 4B, the opening and closing of the variable volume member 3 is repeated, thereby supplying ink from the ink tank 5 to the sub tank 4 and filling the sub tank 4 with the ink. In S302, it is judged whether the sub tank 4 has become filled with ink (full tank) or not as a result of the opening and closing of the variable volume member 3. If the sub tank 4 has not yet become filled with ink completely, it is judged in S303 whether there is any ink in the ink tank 5 or not. If it is judged that there is ink in the ink tank 5, the process returns to S301, and the opening and closing of the variable volume member 3 is performed again. If it is judged that no ink is left in the ink tank 5, in S304, a message saying that ink tank replacement is necessary is displayed. If it is judged in S305 that the empty ink tank has been replaced with new one, the process returns to S301, and the opening and closing of the variable volume member 3 is performed again.

The judgment processing of S303, in which it is judged whether there is any ink in the ink tank 5 or not, is performed by measuring a voltage value or a current value that is obtained when an electric current that is very week is applied between the first hollow pipe 8 and the second hollow pipe 9 as described earlier. The amount of ink left in the ink tank 5 is judged on the basis of the content of the EEPROM 20 on the ink tank 5 if not greater than "near end". In the present embodiment, ink that has a volume of V3 (approx. 0.36 ml) is supplied from the ink tank 5 to the sub tank 4 when the variable volume member 3 is opened and closed once. Therefore, it is possible to calculate the amount of ink left in the ink tank 5 by reading the content of the EEPROM 20.

The judgment processing of S302, in which it is judged whether the sub tank 4 has become filled with ink or not, is performed by measuring a voltage value or a current value that is obtained when an electric current that is very week is applied between the first hollow pipe 8 and the solid pipe 10 as described earlier.

If it is judged in S302 that the sub tank 4 has become filled with ink, the sub-tank filling control ends.

3-3 Ink Amount Detection Timing

Next, the timing of detecting the amount of ink contained in the sub tank during the sub-tank filling operation according to the present embodiment will now be explained. In related art, the detection of the amount of ink contained in a sub tank during sub-tank filling operation is performed at predetermined time intervals. However, the inventors found that it is sometimes detected erroneously that the sub tank is filled with ink despite the fact that there is an empty space inside the sub tank. The inventors investigated the cause of the erroneous detection, and discovered that the erroneous detection occurs because of the following phenomenon.

Figure 7A:
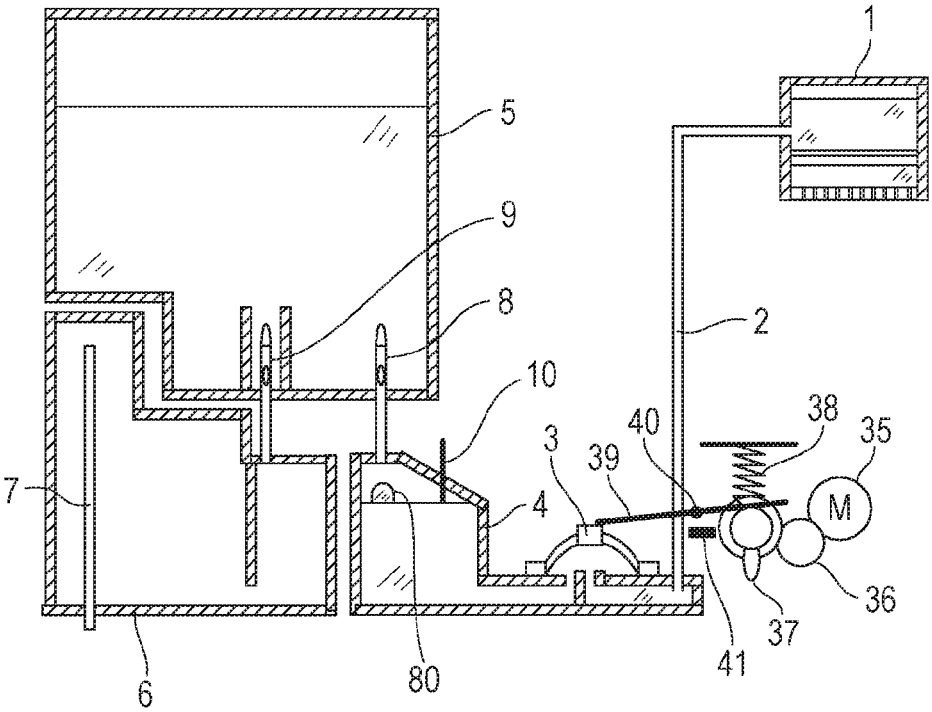
FIG. 7A is a schematic view showing the state of an ink supply device during sub-tank filling operation according to a first embodiment.
Figure 7B:
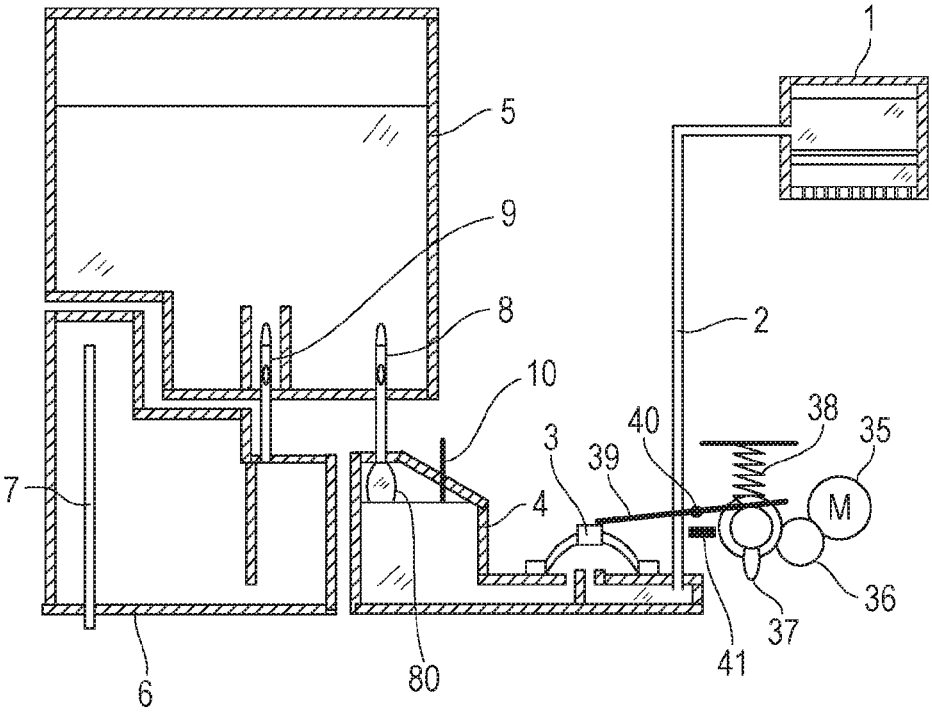
FIG. 7B is a schematic view showing the state of an ink supply device during sub-tank filling operation according to the first embodiment.

FIG. 7 is a schematic view showing the state of an ink supply device during sub-tank filling operation. The state of an ink supply device at two different points in time during sub-tank filling operation is illustrated in FIGS. 7A and 7B. In FIG. 7A, the surface level of liquid ink is sufficiently low and, therefore, no conduction occurs via ink between the first hollow pipe 8 and the solid pipe 10. Therefore, there is no risk of erroneous "filled-with-ink" detection in this case. In contrast, in FIG. 7B, despite the fact that the surface level of liquid ink is sufficiently low inside the sub tank, conduction occurs via ink temporarily between the first hollow pipe 8 and the solid pipe 10 because of the presence of an ink drop 80 supplied through the first hollow pipe 8. For this reason, in this case, erroneous "filled-with-ink" detection occurs. As described above, the inventors found that erroneous detection occurs because of temporary conduction between the first hollow pipe 8 and the solid pipe 10 via an ink drop supplied from the ink tank.

Based on the above findings, in the present embodiment, limitation is imposed on the timing of detecting the amount of ink contained in the sub tank during the sub-tank filling operation. The detection of the amount of ink contained in the sub tank is not performed when it is in the state of FIG. 7B. Specifically, the detection of the amount of ink contained in the sub tank is not performed during a period of time in which the volume of the variable volume member 3 increases. By this means, it is possible to prevent erroneous detection from occurring due to the detection of the amount of ink when in the state of FIG. 7B arising from the supply of ink from the ink tank to the sub tank as a result of the operation of increasing the volume of the variable volume member 3.

Figure 8:
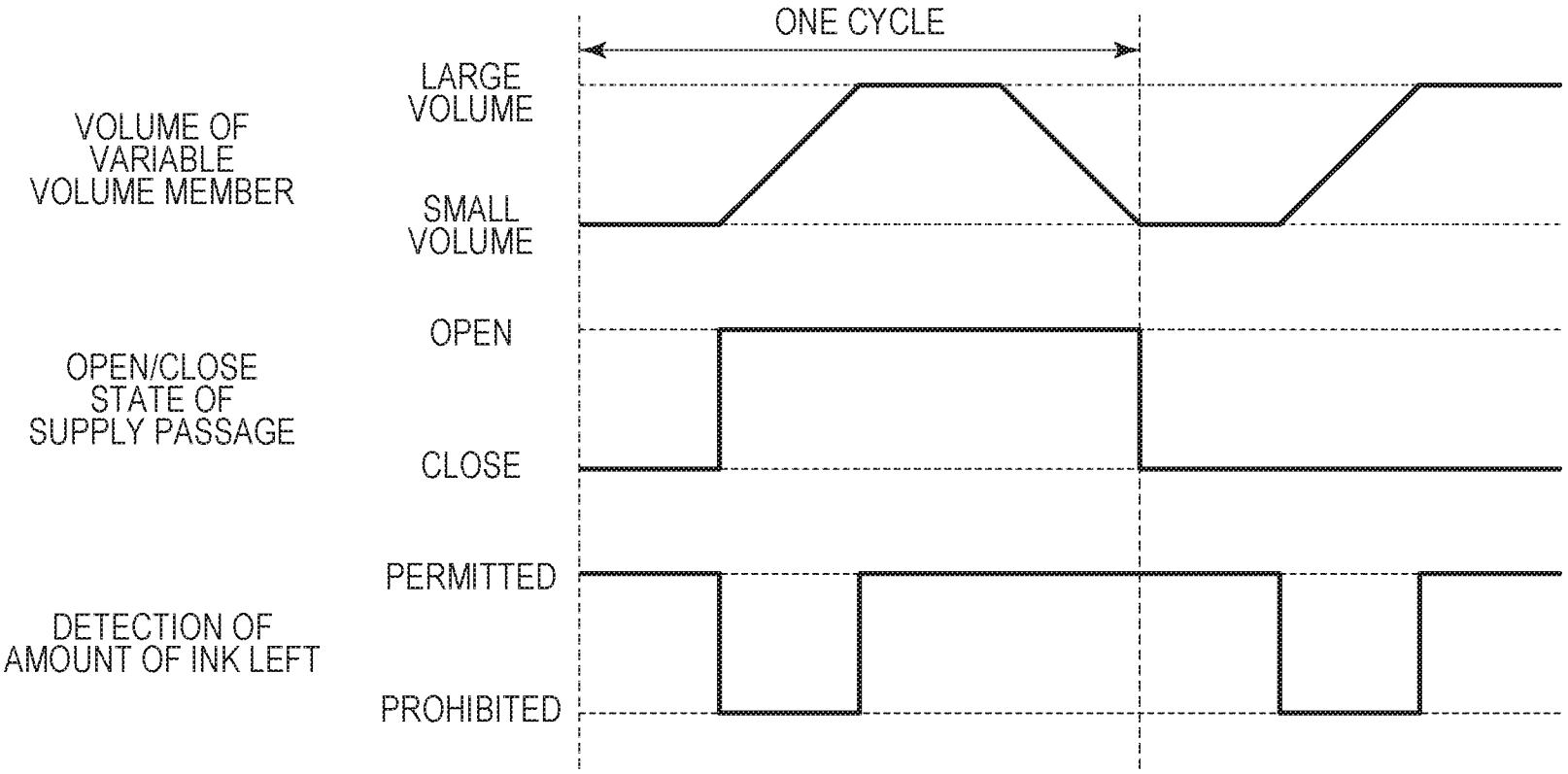
FIG. 8 is a schematic view showing the timing of detecting the amount of ink contained in the sub tank during the sub-tank filling operation according to the first embodiment.

FIG. 8 is a schematic view showing the timing of detecting the amount of ink contained in the sub tank according to the present embodiment. In this timing chart, the detection of the amount of ink contained in the sub tank is prohibited during a period of time in which the variable volume member 3 is switched from a small volume state (closed state) to a large volume state (open state). The detection of the amount of ink contained in the sub tank is permitted during a period of time in which the variable volume member 3 is in the small volume state, is in the large volume state, and is switched from the large volume state to the small volume state.

As described above, with the present embodiment, it is possible to detect the amount of ink contained in the sub tank accurately by imposing limitation on the timing of detecting the amount of ink contained in the sub tank during the sub-tank filling operation.

Second Embodiment

In the present embodiment, a case where the timing of detecting the amount of ink contained in the sub tank during the sub-tank filling operation is more limited than that of the first embodiment is described. The other structure and control in the present embodiment is the same as that of the first embodiment. Therefore, it is not explained here.

In the present embodiment, the detection of the amount of ink contained in the sub tank is prohibited not only during a period of time in which the volume of the variable volume member 3 increases but also before the lapse of a predetermined period of time after the completion of the volume-increasing operation. With this additional limitation, it is possible to prevent conduction between the electrodes from occurring due to the stay of an ink drop 80 on the inner wall of the sub tank for a certain length of time after the completion of the volume-increasing operation.

Figure 9:
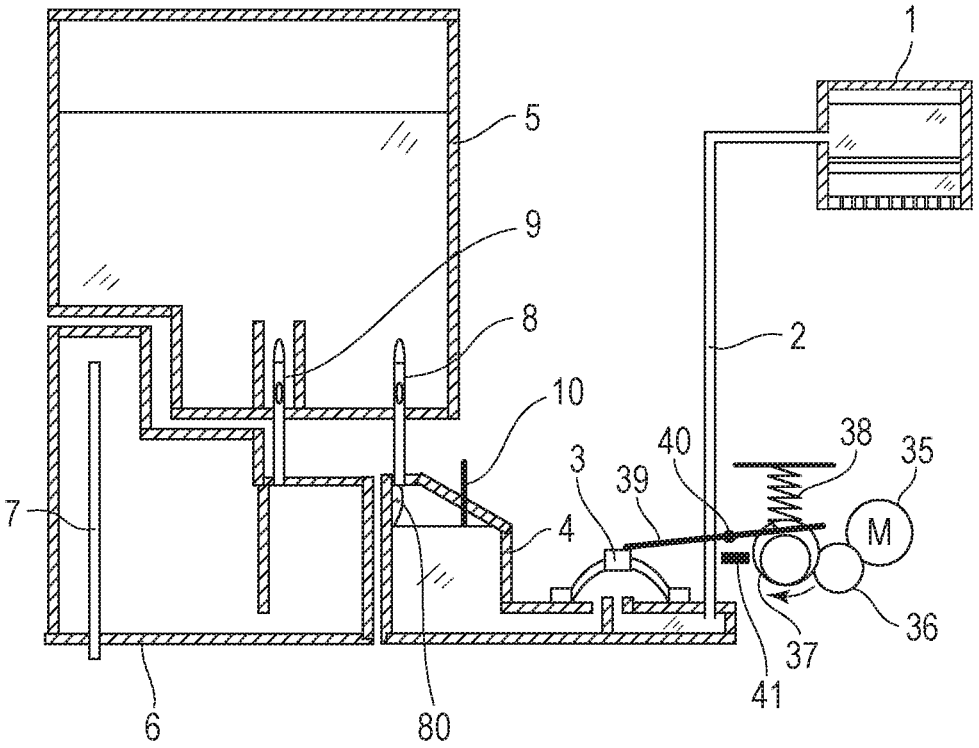
FIG. 9 is a schematic view showing the state of an ink supply device during sub-tank filling operation according to a second embodiment.

FIG. 9 is a schematic view of an ink supply device in a state in which there is an ink drop staying on the inner wall of the sub tank. Depending on some factors including, but not limited to, the distance between the inner wall of the sub tank and the first hollow pipe 8, the shape of the inner wall of the sub tank, the physical properties of the inner wall of the sub tank, and the properties of the ink, the ink drop 80 stays on the inner wall of the sub tank for a certain length of time. In this state, conduction occurs between the first hollow pipe 8 and the solid pipe 10 because of the presence of the ink drop 80. Therefore, despite the fact that the surface level of liquid ink is sufficiently low inside the sub tank, it is detected erroneously that the sub tank is filled with ink, which is not the case.

Figure 10:
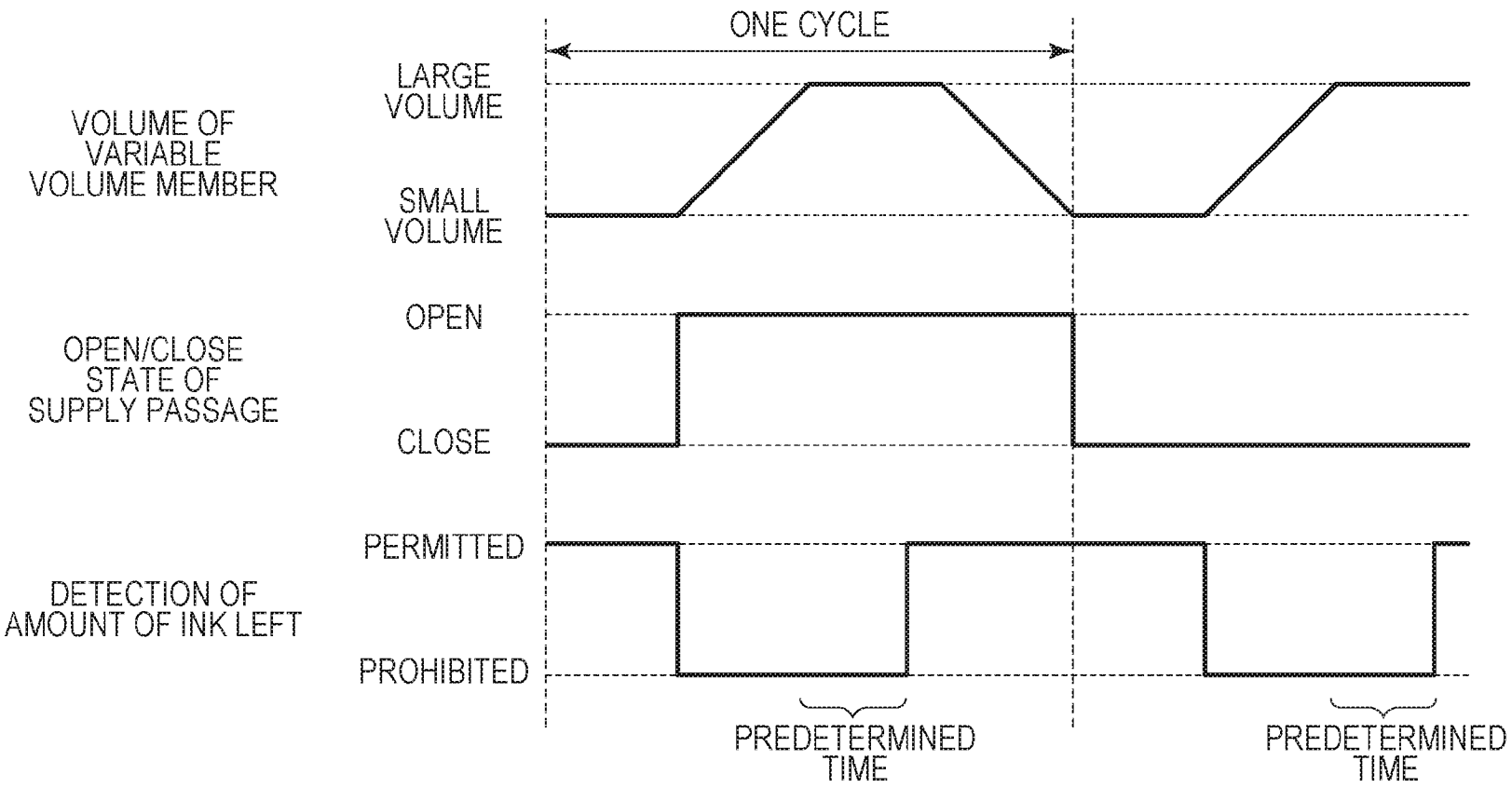
FIG. 10 is a schematic view showing the timing of detecting the amount of ink contained in the sub tank during the sub-tank filling operation according to the second embodiment.

FIG. 10 is a schematic view showing the timing of detecting the amount of ink contained in the sub tank according to the present embodiment. In the present embodiment, the detection of the amount of ink contained in the sub tank is prohibited not only during a period of time in which the volume of the variable volume member 3 increases but also before the lapse of a predetermined period of time after the completion of the volume-increasing operation. In the present embodiment, the predetermined period of the prohibition of ink amount detection is preset as a fixed value. However, this period may be set as a variable value that depends on the type of the ink, the speed of the sub-tank filling operation, or the like.

As described above, with the present embodiment, it is possible to detect the amount of ink contained in the sub tank with greater accuracy than that of the first embodiment by further limiting the timing of detecting the amount of ink contained in the sub tank during the sub-tank filling operation.

Third Embodiment

In the present embodiment, a case where the timing of detecting the amount of ink contained in the sub tank during the sub-tank filling operation is more limited than that of the first and second embodiments is described. The other structure and control in the present embodiment is the same as that of the first and second embodiments. Therefore, it is not explained here.

Figure 11:
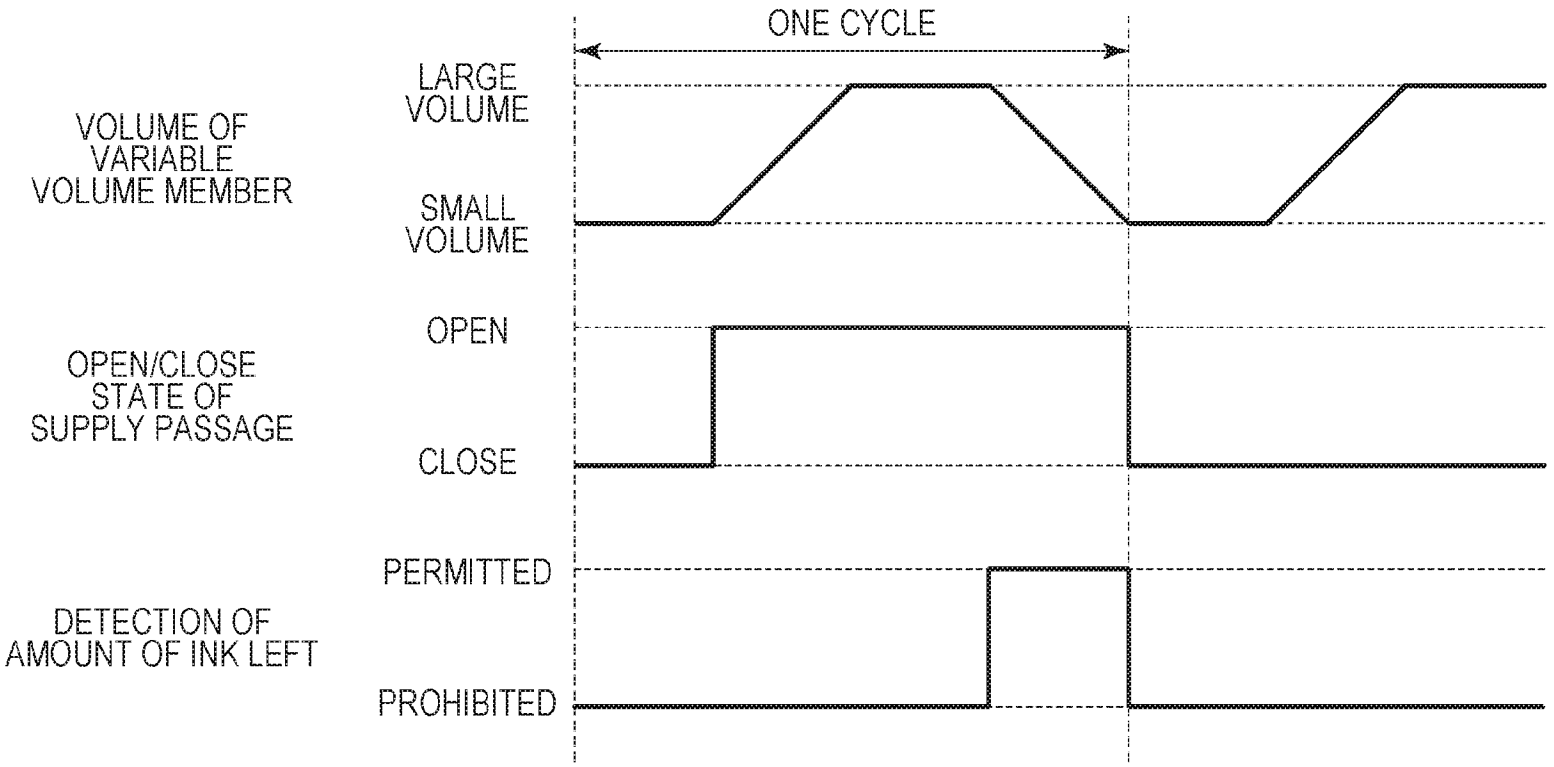
FIG. 11 is a schematic view showing the timing of detecting the amount of ink contained in the sub tank during the sub-tank filling operation according to a third embodiment.

FIG. 11 is a schematic view showing the timing of detecting the amount of ink contained in the sub tank according to the present embodiment. In the present embodiment, the detection of the amount of ink contained in the sub tank is permitted only during a period of time in which the volume of the variable volume member 3 decreases. No ink is supplied from the ink tank to the sub tank during a period of time in which the volume of the variable volume member 3 decreases. Moreover, almost no ink droplet will probably exist on the inner wall of the sub tank. Therefore, during a period of time in which the volume of the variable volume member 3 decreases, the conduction via the ink drop 80 between the first hollow pipe 8 and the solid pipe 10 illustrated in FIG. 7B does not occur. For this reason, it is possible to prevent erroneous detection from occurring.

As described above, with the present embodiment, it is possible to detect the amount of ink contained in the sub tank with greater accuracy than that of the first and second embodiments by further limiting the timing of detecting the amount of ink contained in the sub tank during the sub-tank filling operation.

Other Embodiments

In the foregoing embodiments, the variable volume member has an on-off valve function for switching between an ink-flow-passage closed state and an ink-flow-passage open state in addition to a function of supplying ink from the ink tank to the sub tank. However, instead of providing the variable volume member with the on-off valve function, an on-off valve may be provided separately from the variable volume member. In this case, the variable volume member should preferably be provided between the sub tank and the on-off valve. A diaphragm valve, an accordion-shaped member, or other flexible member that has variable volume can be used as the variable volume member.

Figure 12:
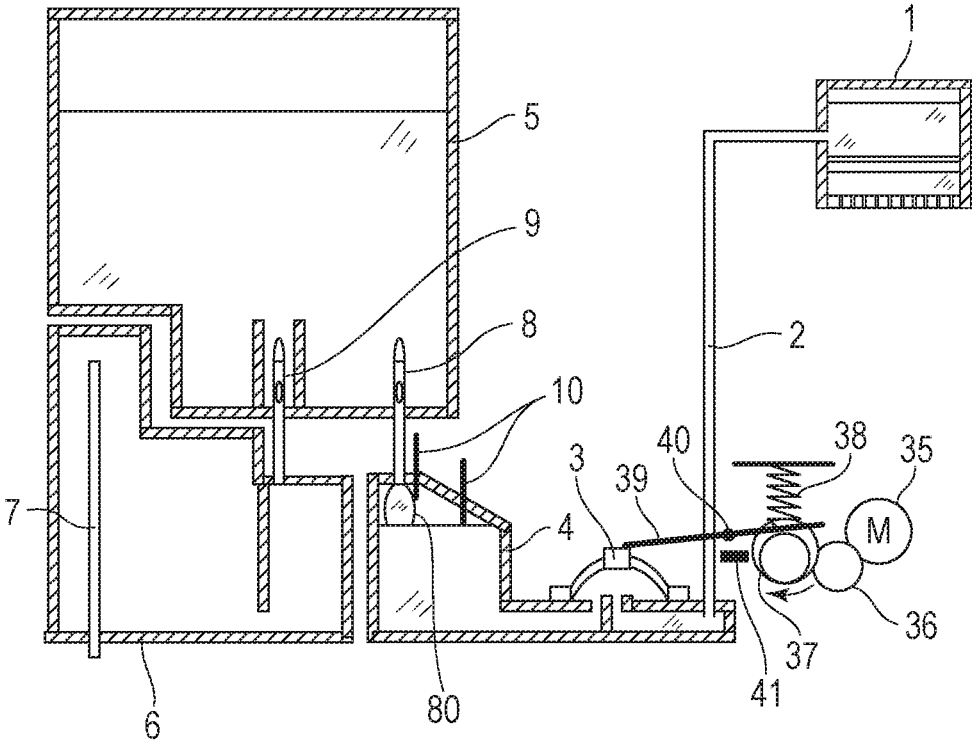
FIG. 12 is a schematic view showing the state of an ink supply device during sub-tank filling operation according to a variation example of the present invention.

In the foregoing embodiments, the first hollow pipe 8 serving as the ink flow passage between the ink tank and the sub tank constitutes a part of a detector configured to detect the amount of ink contained in the sub tank. However, as illustrated in FIG. 12, a detector (detection sensor) may be provided separately near the first hollow pipe 8. Even with such a modification, the effects of the aspects of the present invention can be expected.

Figure 13:
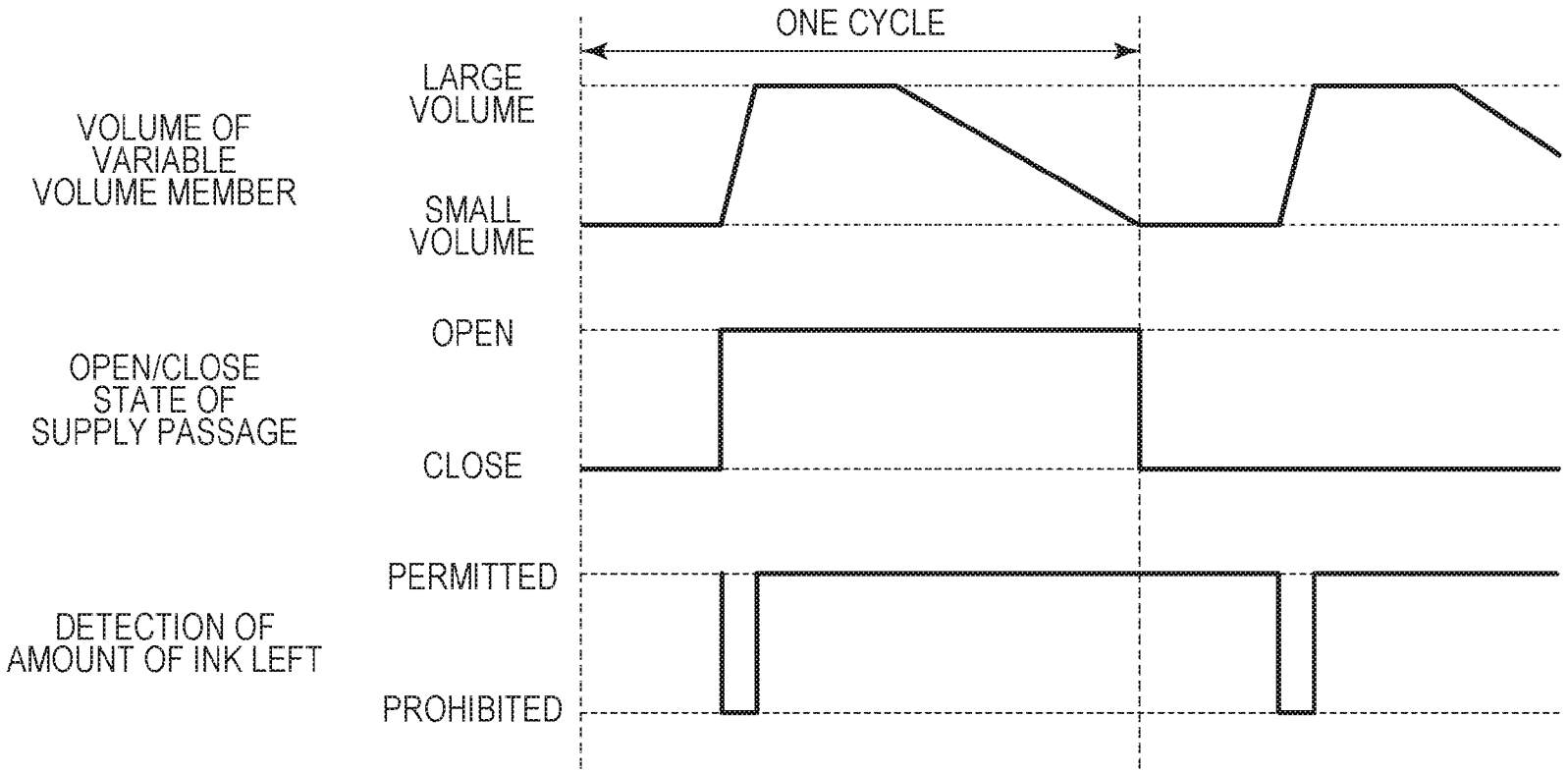
FIG. 13 is a schematic view showing the timing of detecting the amount of ink contained in the sub tank during the sub-tank filling operation according to a variation example of the present invention.
Figure 14:
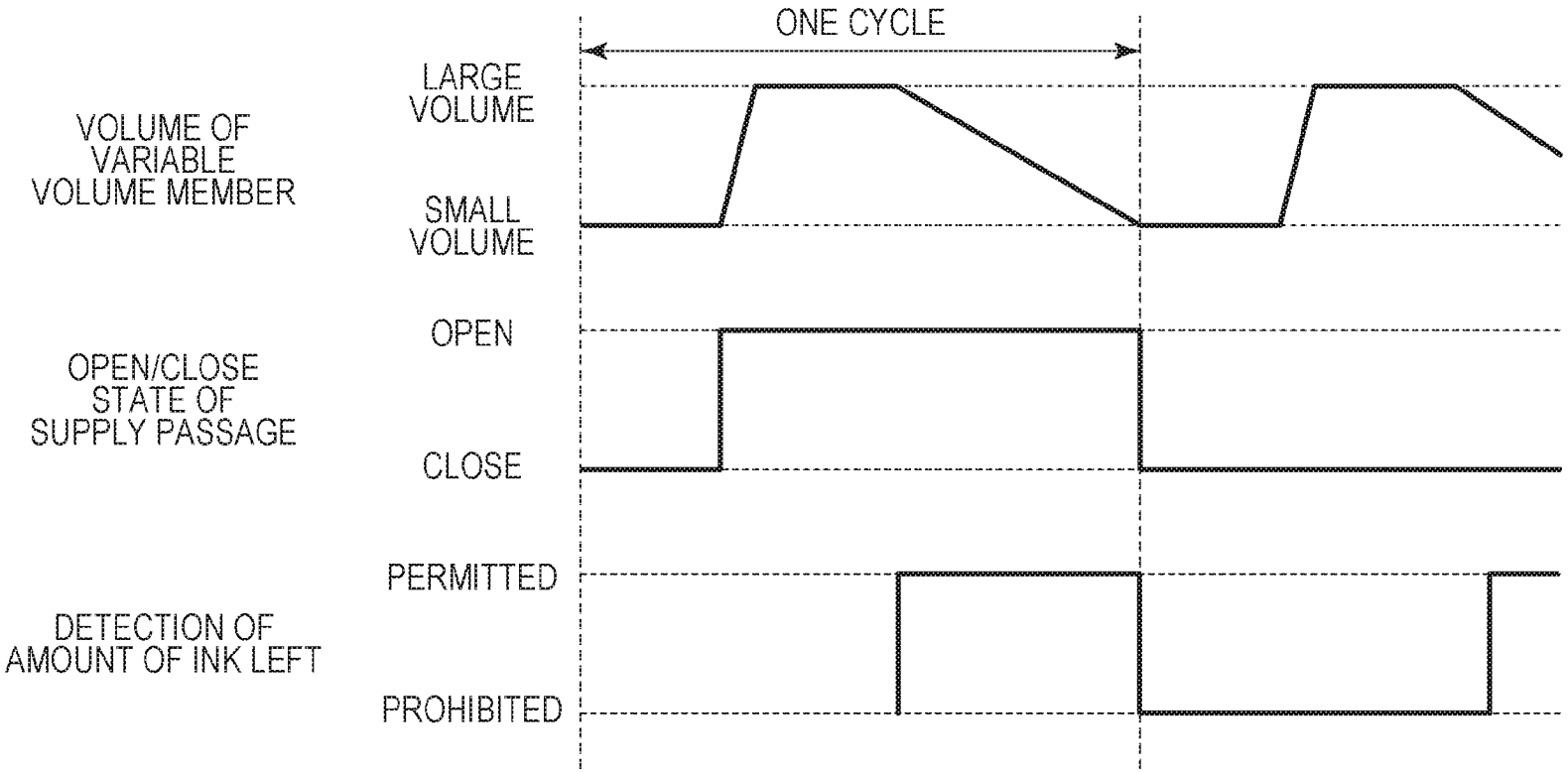
FIG. 14 is a schematic view showing the timing of detecting the amount of ink contained in the sub tank during the sub-tank filling operation according to a variation example of the present invention.
Figure 15A:
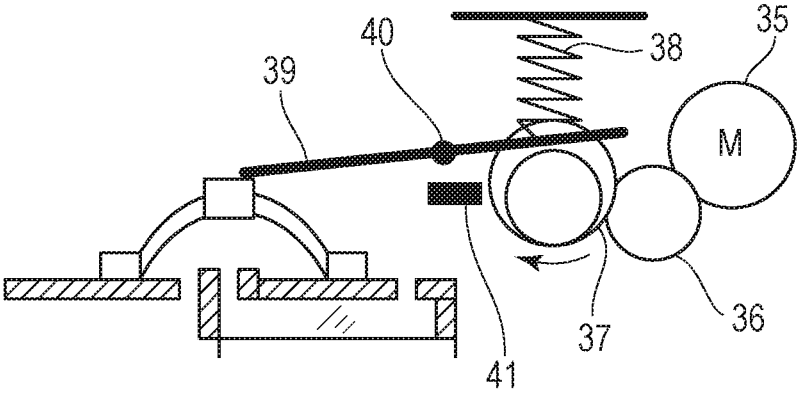
FIG. 15A is a schematic view showing the shape of a cam driving a variable volume member according to an exemplary embodiment of the present invention.
Figure 15B:
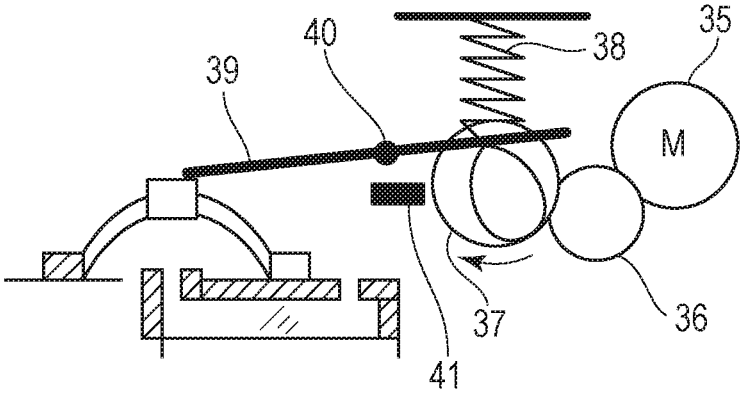
FIG. 15B is a schematic view showing the shape of a cam driving a variable volume member according to a variation example of the present invention.

In the foregoing embodiments, as illustrated in FIGS. 8, 10, and 11, the time taken for increasing the volume of the variable volume member is approximately the same as the time taken for decreasing the volume of the variable volume member. FIGS. 13 and 14 are schematic view showing the timing of detecting the amount of ink contained in the sub tank during the sub-tank filling operation according to a variation example of the present invention. As illustrated in FIGS. 13 and 14, for the purpose of making the time during which the detection of the amount of ink contained in the sub tank is prohibited as short as possible, preferably, the time taken for increasing the volume of the variable volume member should be shorter than the time taken for decreasing the volume of the variable volume member. For this purpose, the cam 37 may have an asymmetrical cam shape as illustrated in FIG. 15B instead of a simple eccentric cam shape as illustrated in FIG. 15A. Alternatively, the time taken for increasing the volume of the variable volume member may be made shorter than the time taken for decreasing the volume of the variable volume member by drive control of the cam 37.

As described above, with the aspects of the present invention, it is possible to provide an ink-jet recording apparatus that enables detecting the amount of ink contained in a sub tank accurately.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-107874, filed May 27, 2015, which is hereby incorporated by reference herein in its entirety.

What is claimed is:

1. An ink-jet recording apparatus, comprising:

a recording head configured to eject ink;

a sub tank containing ink to be supplied to the recording head;

an ink tank containing ink to be supplied to the sub tank;

a detector configured to detect an amount of ink contained in the sub tank;

a variable volume member provided between the recording head and the sub tank and configured to change inner volume; and a controller configured to repeatedly perform first operation and second operation, thereby supplying the ink from the ink tank to the sub tank, the first operation causing the variable volume member to switch from a first state to a second state, the second operation causing the variable volume member to switch from the second state to the first state, wherein volume of the variable volume member in the second state is larger than the volume in the first state, wherein the controller prohibits the detector from detecting the amount of the ink during a period of time in which the first operation is performed.

2. The ink-jet recording apparatus according to claim 1, wherein, in the second state, the controller prohibits the detector from detecting the amount of the ink before lapse of a predetermined period of time after completion of the first operation.

3. The ink-jet recording apparatus according to claim 1, wherein the controller prohibits the detector from detecting the amount of the ink in the second state.

4. The ink-jet recording apparatus according to claim 1, wherein the controller permits the detector to detect the amount of the ink during a period of time in which the second operation is performed.

5. The ink-jet recording apparatus according to claim 1, wherein the variable volume member causes the ink to be supplied from the ink tank to the sub tank when the first operation is performed and causes air to be sent from the sub tank to the ink tank when the second operation is performed.

6. The ink-jet recording apparatus according to claim 1, wherein the variable volume member closes an ink flow passage between the recording head and the sub tank in the first state and opens the ink flow passage in the second state.

7. The ink-jet recording apparatus according to claim 1, further comprising:

a pair of electrodes provided at least partially inside the sub tank, wherein the detector detects the amount of the ink contained in the sub tank by measuring a voltage value or a current value between the pair of electrodes.

8. The ink-jet recording apparatus according to claim 7, wherein either one of the pair of electrodes serves as an ink flow passage between the sub tank and the ink tank.

9. The ink-jet recording apparatus according to claim 1, wherein time taken for the first operation is shorter than that for the second operation.

* * * * *